US006700085B2

(12) United States Patent
Teruyama et al.

(10) Patent No.: US 6,700,085 B2
(45) Date of Patent: Mar. 2, 2004

(54) PUSH SWITCH WITH IMPROVED CLICK SPRING

(75) Inventors: Shuji Teruyama, Iizuka (JP); Kazunori Hamasaki, Iizuka (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/019,874

(22) PCT Filed: May 17, 2001

(86) PCT No.: PCT/JP01/04117

§ 371 (c)(1),
(2), (4) Date: Dec. 26, 2001

(87) PCT Pub. No.: WO01/88936

PCT Pub. Date: Nov. 22, 2001

(65) Prior Publication Data

US 2003/0098225 A1 May 29, 2003

(30) Foreign Application Priority Data

May 18, 2000 (JP) ..... 2000-146328

(51) Int. Cl.[7] ..... H01H 5/18

(52) U.S. Cl. ..... 200/406; 200/5 A; 200/159; 200/275; 200/292

(58) Field of Search ..... 200/406, 5 A, 200/159, 275, 292

(56) References Cited

U.S. PATENT DOCUMENTS 4,307,268 A 12/1981 Harper

FOREIGN PATENT DOCUMENTS

GB 2122422 4/1983
JP 10-134667 * 10/1996

OTHER PUBLICATIONS

English abstract of JP01221824.

English abstract of JP09231863.

English abstract of JP10134667.

English translation of the Claims of JP6075930.

* cited by examiner

*Primary Examiner*—Karl D. Easthom
*Assistant Examiner*—Jennifer A Poker
(74) *Attorney, Agent, or Firm*—Ladas & Parry

(57) ABSTRACT

The present invention has as its object to provide a push switch utilizing a click spring with superior electrical conduction during operation of the switch.

The push switch 20 of the present invention has a fixed contact 4, and a spherical click spring that contacts the fixed contact 4 and acts as a traveling contact, the click spring 10 having a projection 11*a* that projects upward from a central part of the click spring 10, and further, an aperture part 11 formed inside the projection so as to be open at the bottom. When the projection 11*a* is pressed downward the bottom edge 11*b* of the aperture part and the fixed contact 4 form a line contact (see FIG. 2).

6 Claims, 3 Drawing Sheets

PRIOR ART

PRIOR ART

PUSH SWITCH WITH IMPROVED CLICK SPRING

TECHNICAL FIELD

The present invention relates to a push switch employing a click spring, and more particularly, to a push switch employing a click spring designed to stabilize contact between a traveling contact and a fixed contact.

BACKGROUND ART

Conventionally, a push switch employing a spherical click spring is used for control signal input for a variety of audio, video and other electronic equipment.

FIGS. 4 and 5 show one example of a conventional push switch employing a conventional spherical click spring. As shown in the diagrams, in the conventional push switch 1, a fixed contact 4 and a fixed contact 5 are provided at a center and an exterior edge of an interior floor of a button holder 3 of a resin base 2. Further, a spherical click spring 6 is inserted inside the button holder 3, an outer edge part of the spherical click spring 6 is bonded to the outer fixed contact 5, and a central part is provided so as to be positioned atop the fixed contact 4. Additionally, a small-diameter top part 7*a* of a push button 7 placed on a top of the spherical click spring 6 projects upward from a central hole in a button cover 8 that is affixed to a top of the base 2.

In the above-described push switch 1, when the push button 7 is pressed downward, as shown in FIG. 5 a convex part 7*b* provided on a central part of a bottom surface of the push button 7 depresses the spherical click spring 6 that functions as a traveling contact, inverting it so that the center of the spherical click spring 6 contacts the central fixed contact 4. As a result, the spherical click spring 6 establishes an electrical conduction between the fixed contact 4 and outer fixed contact 5.

In the above-described push switch 1, when the spherical click spring 6 inverts, a center point C of the spherical click spring 6 contacts the central fixed contact 4 as shown in FIG. 5 and FIG. 6 and a state of electrical conduction is obtained between the fixed contact 5 and the fixed contact 4. However, if particles and the like remaining inside the push switch 1 adhere to the top of the central fixed contact 4, then an adequate electrical conduction is not obtained and problems arise with respect to the electrical properties of the apparatus such as the electric capacity, resistance and so forth, interfering with the reliability of the apparatus as a push switch.

DISCLOSURE OF THE INVENTION

The present invention was conceived as a solution to the above-mentioned problem, and has as its object to provide a push switch utilizing an improved click spring that avoids the adverse effects of particulate matter and stabilizes the electrical conduction between fixed contacts during operation of the switch.

The present invention was proposed in order to achieve the above-described objects, and comprises a push switch comprising a fixed contact and a spherical click spring that functions as a traveling contact, the click spring comprising a projection that projects upward from a central part of the click spring and an aperture part open at a bottom being formed inside the projection, such that when the projection is depressed a bottom edge of the aperture part and the fixed contact form a line contact.

A projection that projects upward in order to form an aperture portion open at the bottom is provided on a center portion of the spherical click spring used in the push switch of the present invention, so when the push button is pressed the spherical click spring is depressed and inverted, contacting the center portion of the spherical click spring with the central fixed contact and causing an electrical conduction to form between the central fixed contact and the outer fixed contact. At this time, the bottom edge of the aperture part open at the bottom forms a line contact with the central fixed contact in a circular or other, square shape, so the pressure with which the spherical click spring contacts the central fixed contact increases, cutting out dust particles adhering to the top of the central fixed contact and enabling adverse effects of dust particles and the like on the electrical conduction between fixed contacts to be reduced to a minimum and improving the stability of the electrical conduction of the push switch.

BEST EMBODIMENT FOR PRACTICING THE INVENTION

A detailed description will now be given of an embodiment of the present invention, with reference to FIGS. 1 through 3.

Figure 1:
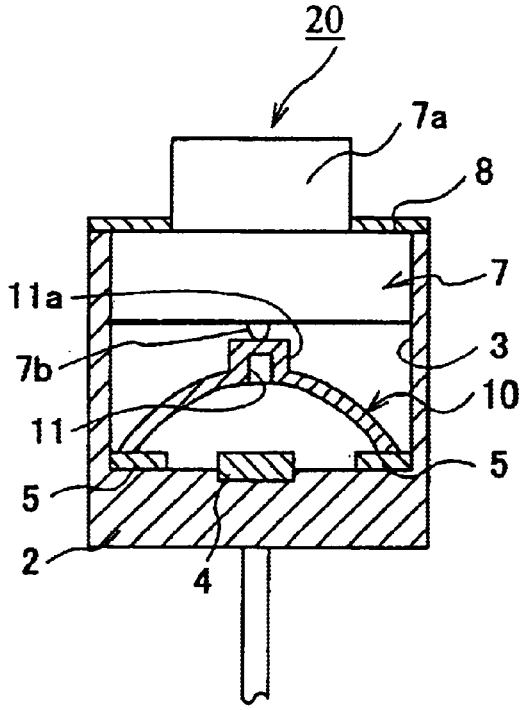
FIG. 1 shows a cross-sectional view of a push switch using a click spring of the present invention.
Figure 2:
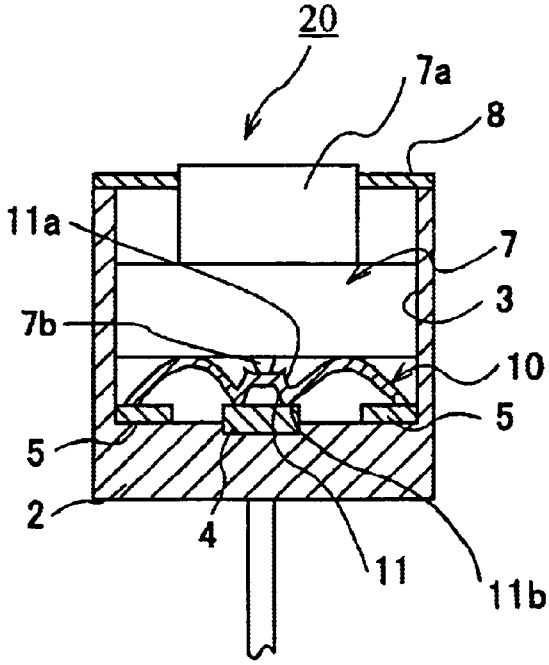
FIG. 2 shows a longitudinal cross-sectional view of a push switch in a state in which the click spring shown in FIG. 1 is depressed and inverted.
Figure 3:
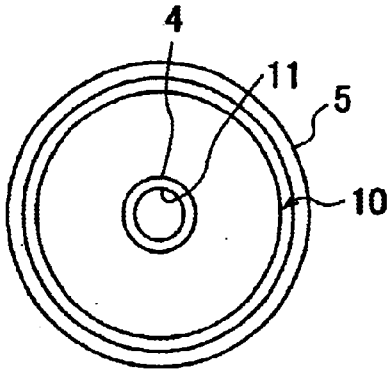
FIG. 3 is a diagram illustrating a state of electrical conduction of the click spring of the push switch in the state shown in FIG. 2.
Figure 4:
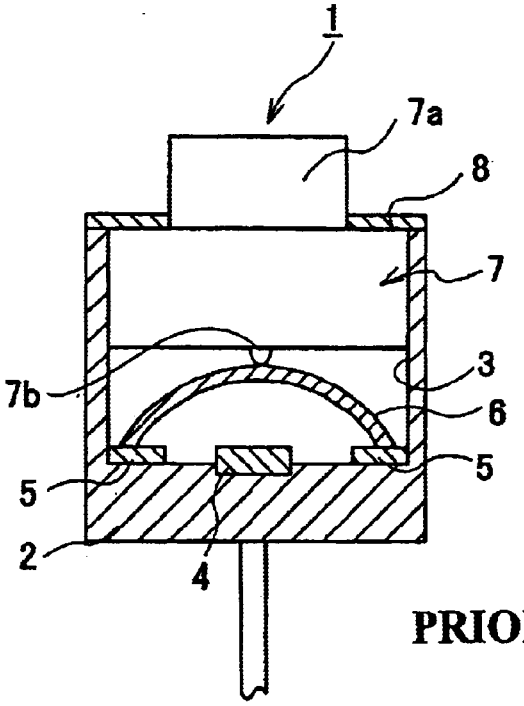
FIG. 4 is a longitudinal cross-sectional view of a conventional push switch using a conventional spherical click spring.
Figure 5:
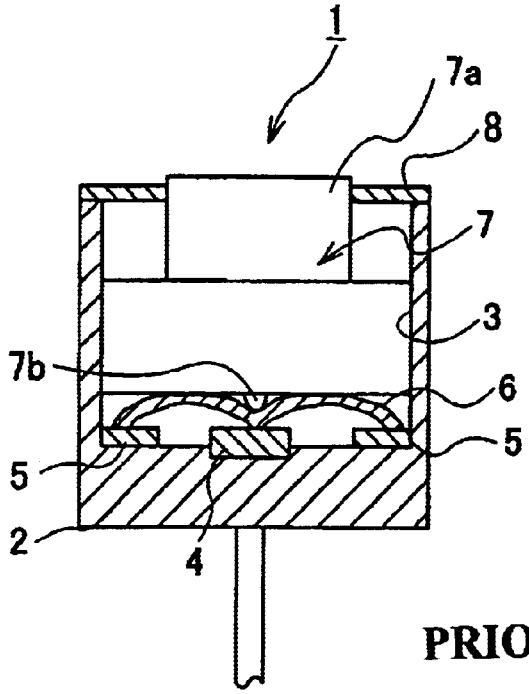
FIG. 5 is a longitudinal cross-sectional view of the push switch in a state in which the spherical click spring shown in FIG. 4 is depressed and inverted
Figure 6:
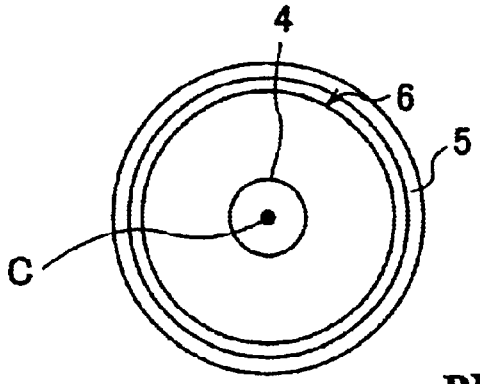
PRIOR ART FIG.6
FIG. 6 is a diagram illustrating a state of electrical conduction of the click spring of the push switch in the state shown in FIG. 5.

As shown in FIGS. 1 through 3, in a push switch 20 according to one embodiment of the present invention a fixed contact 5 and a fixed contact 4 are provided at a center and an exterior edge of an interior floor of a button holder 3 of a resin base 2. A spherical click spring 10 of the present invention that functions as a traveling contact for the purpose of turning the fixed contact 4 and the fixed contact 5 ON and OFF electrically is inserted inside the button holder 3.

The spherical click spring 10 of the present invention is formed from a metallic plate of suitable thickness, configured so as to have an elastic restorative force provided by such metallic plate. By providing a half punch of approximately half the thickness of the metallic plate at the center of the spherical click spring 10, a projection 11*a* for forming a cylindrical aperture 11 open at the bottom inside the center of the spherical click spring 10 is positioned so as to project upward from the center of the spherical click spring 10. Additionally, the outer edge of the spherical click spring 10 is bonded to the outer fixed contact 5, with the center of the spherical click spring 10 disposed so as to be positioned above the central fixed contact 4.

It should be noted that the formation method of the aforementioned aperture part 11 is not limited to the aforementioned half punch method, but may instead be formed by any method that allows the projection 11*a* for the purpose of forming the cylindrical aperture part 11 open at the bottom in the center of the spherical click spring 10 to project upward from the center of the spherical click spring 10. Additionally, the shape of the aforementioned aperture part 11 is not limited to that of a cylinder but may be square instead, nor should the depth of the hole so formed be particularly limited.

In the push switch 20 of the present embodiment, a small-diameter top part 7*a* of a push button 7 mounted on top of the spherical click spring 10 projects upward from a central hole in a button cover fixedly mounted atop the base 2.

In the push switch 20 of the present embodiment, as shown in FIGS. 2 and 3, when the push button 7 is pressed, a convexity 7*b* projecting from the center of the bottom of the push button 7 presses down on the aforementioned projection 11*a* provided at the center of the spherical click spring 10, causing the spherical click spring 10 to invert. At the same time, a bottom edge 11*b* of the aperture part 11 of the spherical click spring 10 contacts the central fixed contact 4 in a state of being a round or square shape, with the result that an electrical conduction is formed between the central fixed contact 4 and the outer fixed contact 5 via the spherical click spring 10 that acts as a traveling contact.

In the push switch 20 of the embodiment described above, the bottom edge 11*b* of the aperture part 11 provided in the central portion of the aforementioned spherical click spring 10 contacts the central fixed contact 4 in a state of being a round or square shape, thus improving the contact pressure of the spherical click spring 10 and enabling the dust particles and the like adhering to the top of the aforementioned fixed contact 4 to be effectively cut out, making it possible to avoid the adverse effects of dust particles and the like on the electrical conduction between fixed contacts. Accordingly, the push switch 20 using the spherical click spring 10 of the present embodiment improves the stability of the electrical conduction between the fixed contacts 4, 5 created by the operation of the switch, and also contributes to the effectiveness of the electrical contact through multiple points of contact.

As described above, a projection that projects upward in order to form an aperture portion open at the bottom is provided on a center portion of the spherical click spring used in the push switch of the present invention, so when the push button is pressed the spherical click spring is depressed and inverted, contacting the center portion of the spherical click spring with the central fixed contact and causing an electrical conduction to form between the central fixed contact and the bottom edge of the aperture portion. At this time, the bottom edge of the aperture part open at the bottom forms a line contact with the central fixed contact in a circular or other, square shape, so the pressure with which the spherical click spring contacts the central fixed contact increases, cutting out dust particles adhering to the top of the central fixed contact and enabling adverse effects of dust particles and the like on the electrical conduction between fixed contacts to be reduced to a minimum and improving the stability of the electrical conduction of the push switch. Additionally, it is possible to provide a push switch with superior electrical conduction with a structure that is extremely simple and without an increase in the number of parts, making it possible to reduce costs and to contribute to improving the electrical properties of the apparatus such as the electric capacity, resistance and so forth.

What is claimed is:

1. A push switch comprising: a fixed contact; and a spherical click spring that functions as a traveling contact that contacts the fixed contact, the click spring having a projection that projects upward from a central part of the click spring and an aperture part open at a bottom being formed inside the projection, said projection being formed to be approximately half the thickness of the click spring such that when the projection is depressed a bottom edge of the aperture part and the fixed contact form a line contact.

2. The push switch as claimed in claim 1, wherein dust particles adhering to a top of the fixed contact are rubbed off by the bottom edge of the aperture part formed inside the projection of the click spring forming a line contact with the fixed contact.

3. The push switch as claimed in claim 1, wherein the aperture part formed inside the projection of the click spring is a cylindrical hole and the bottom edge of the aperture part is circular.

4. The push switch as claimed in claim 1, wherein the aperture part formed inside the projection of the click spring is a square hole and the bottom edge of the aperture part is square.

5. The push switch as claimed in claim 1, further comprising a second fixed contact provided on an exterior of the fixed contact, an exterior edge of the click spring being bonded to the second fixed contact, a center of the click spring provided so as to be positioned above a side of the fixed contact that contacts the bottom edge of the aperture part.

6. The push switch as claimed in claim 1, further comprising a push button mounted on top of the click spring, such that when the push button is depressed the projection of the click spring is depressed by the push button, causing the click spring to invert and the bottom edge of the aperture part to form a line contact with the fixed contact so as to rub off dust particles adhering to the top of the fixed contact.

* * * * *